US008245530B2

(12) United States Patent
Sugitani

(10) Patent No.: US 8,245,530 B2
(45) Date of Patent: Aug. 21, 2012

(54) INLET GUIDE VANE, COMPRESSOR AND REFRIGERATOR

(75) Inventor: Noriyasu Sugitani, Yokohama (JP)

(73) Assignee: IHI Corporation (JP)

( * ) Notice: Subject to any disclaimer, the term of this patent is extended or adjusted under 35 U.S.C. 154(b) by 808 days.

(21) Appl. No.: 12/366,938

(22) Filed: Feb. 6, 2009

(65) Prior Publication Data

US 2009/0196745 A1 Aug. 6, 2009

(30) Foreign Application Priority Data

Feb. 6, 2008 (JP) ..... P2008-027075

(51) Int. Cl.
*F25B 1/00* (2006.01)

(52) U.S. Cl. ..... 62/498

(58) Field of Classification Search ..... 62/498, 62/440; 415/131, 148, 208.1
See application file for complete search history.

(56) References Cited

U.S. PATENT DOCUMENTS

2007/0147984 A1 6/2007 Takahashi et al. ..... 415/100

FOREIGN PATENT DOCUMENTS

| | | |
|---|---|---|
| JP | 61-215499 | 9/1986 |
| JP | 4-224299 | 8/1992 |
| JP | 2000-291597 | 10/2000 |
| JP | 2007-177695 | 7/2007 |

OTHER PUBLICATIONS

Chinese Office Action, dated Jul. 13, 2010, issued in corresponding Chinese Patent Application No. 200910003838.5, total 4 pages. English Translation attached, 5 pages.

*Primary Examiner* — Melvin Jones
(74) *Attorney, Agent, or Firm* — Ostrolenk Faber LLP

(57) ABSTRACT

An inlet guide vane is turnably installed about an axis line at a suction port into which a fluid is drawn by rotation of an impeller in order to adjust a suction amount and flow direction of the fluid, the inlet guide vane, and includes: a shaft that is turnably supported by inserting a round bar-shaped shaft main body portion thereof in a bearing sleeve; and a plate-shaped vane main body that is joined with the shaft and projects from an inner periphery surface of the suction port to a central portion of the suction port, the shaft including a flange portion that is provided at a distal end side in a direction of the axis line to join with the vane main body and that extends to an outside in a direction perpendicular to the axis line so as to be extended outward in a radial direction of the bearing sleeve.

4 Claims, 7 Drawing Sheets

INLET GUIDE VANE, COMPRESSOR AND REFRIGERATOR

BACKGROUND OF THE INVENTION

1. Field of the Invention

The present invention relates to an inlet guide vane installed at a suction port where a fluid is drawn in by rotation of an impeller for adjusting the suction amount and flow direction of a fluid, a compressor that is provided with it, and a refrigerator that is provided with this compressor.

Priority is claimed on Japanese Patent Application No. 2008-27075, filed Feb. 6, 2008, the content of which is incorporated herein by reference.

2. Description of Related Art

As a refrigerator that cools or refrigerates a cooling object such as water, there is known a refrigerator and the like that is equipped with a compressor that compresses and discharges a refrigerant (fluid) with an impeller. In a compressor, when the compression ratio becomes large, the discharge temperature of the compressor becomes high, causing a drop in volume efficiency. For this reason, there is also a compressor constituted so as to perform compression of the refrigerant over a plurality of stages. For example, a turbo compressor disclosed in Japanese Unexamined Patent Application, First Publication No. 2007-177695 has two compression stages that are provided with an impeller and a diffuser, and sequentially compresses the refrigerant with these compression stages.

In such a turbo compressor, a suction port for drawing a refrigerant inside by rotation of an impeller of a first compression stage is established in such a turbo compressor is provided. A plurality of inlet guide vanes for adjusting the suction amount and the flow direction of the refrigerant are arranged in parallel in the circumferential direction in the suction port of this turbo compressor.

An inlet guide vane 100 shown for example in FIG. 8 has a shaft 101 and plate-shaped vane body 102 in an approximate fan shape viewed from the side that is joined in a state of a mutual axis line O1 being disposed coaxially on this shaft 101 (for example, refer to Japanese Patent Publication No. 2626253 (Japanese Unexamined Patent Application, First Publication No. H04-224299)). The shaft 101 has a shaft main body portion 107 and a stage portion 108. A bearing sleeve 106 of a drive mechanism 105 is fixed to a housing 104 which forms a suction port 103. The shaft main body portion 107 has a cylindrical shape, and is inserted in this bearing sleeve 106 to be supported in a manner capable of turning about the axis line O1. The stage portion 108 is provided at the distal end side in the axis line O1 direction to join with the vane main body 102, and has an outer diameter (width B1 in the direction perpendicular to the axis line O1) approximately equal to the outer diameter d1 of the bearing sleeve 106. This inlet guide vane 100 is supported in a state of the shaft main body portion 107 being inserted in the bearing sleeve 106. The inlet guide vane 100 is installed in the state of the vane main body 102 projected to the inside in the radial direction from the inner periphery surface 103*a* of the suction port 103 to the center portion. At this time, the inlet guide vane 100 is installed so as to receive the stage portion 108 with an end portion 106*a* of the bearing sleeve 106.

The inlet guide vane 100 installed in this way adjusts the suction amount and the flow direction of the refrigerant that is drawn in by turning about the axis line O1 with the drive mechanism 105 according to the angle of attack (turning angle) of each inlet guide vane 100.

However, in the above-mentioned conventional inlet guide vane 100, since the stage portion 108 of the shaft 101 has an outer diameter (width B1) approximately equal to the outer diameter d1 of the bearing sleeve 106 so as to be receivable by the bearing sleeve 106, the stage portion 108 is small. For this reason, when the inlet guide vane 100 is pressed by the flow of the refrigerant, and the stage portion 108 makes partial contact with the bearing sleeve 106 (while adjusting the flow amount and flow direction of the refrigerant), a locally large thrust force N acts on the end portion 106*a* of the bearing sleeve 106. Thereby, local eccentric wear occurs at the bearing sleeve 106, leading the problem of the service life of the bearing sleeve 106 being shortened.

SUMMARY OF THE INVENTION

The present invention has been achieved in view of the above circumstances, and has as its object to provide an inlet guide vane that is capable of prolonging the life of a bearing sleeve by reducing the thrust force that acts on the bearing sleeve during adjustment of the flow amount and flow direction of a fluid to reduce wear, a compressor that provided with it, and a refrigerator that is provided with this compressor.

In order to attain the above-mentioned object, this invention provided the following means.

An inlet guide vane according to the present invention is turnably installed about an axis line at a suction port into which a fluid is drawn by rotation of an impeller in order to adjust a suction amount and flow direction of the fluid, the inlet guide vane, and includes: a shaft that is turnably supported by inserting a round bar-shaped shaft main body portion thereof in a bearing sleeve; and a plate-shaped vane main body that is joined with the shaft and projects from an inner periphery surface of the suction port to a central portion of the suction portion, the shaft including a flange portion that is provided at a distal end side in a direction of the axis line to join with the vane main body and that extends to an outside in a direction perpendicular to the axis line so as to be extended outward in a radial direction of the bearing sleeve.

According to this constitution, the flange portion of the shaft is extended outward in the radial direction of the bearing sleeve, and the width of the flange portion in the direction perpendicular to the axis line is formed large. For this reason, when the inlet guide vane is pressed by the flow of a fluid (when adjusting the suction amount and flow direction of a fluid), it is possible to cause the thrust load to act not only on the bearing sleeve but also for example on the housing that forms the suction port that the flange portion is engaged with. That is, it is possible to enlarge the surface area on which the thrust load acts. Thereby, it is possible to prevent a large thrust load from acting in a concentrated manner (locally) on the end portion of the bearing sleeve, and it is possible to reliably prevent local, eccentric wear occurring on the bearing sleeve. Thereby, the replacement life of the bearing sleeve can be prolonged.

Also, in the inlet guide vane according to the present invention, a width of the flange portion in the direction perpendicular to the axis line is preferably a size of at least 1.5 times an outer diameter of the shaft main body portion and/or at least ⅓ of a maximum width of the vane main body.

According to this constitution, the width of the flange portion of the shaft is a size of at least 1.5 times the outer diameter of the shaft main body portion and/or at least ⅓ of the maximum width of the vane main body. For this reason, it is possible to reliably prevent a large thrust load from acting in a concentrated manner on the end portion of the bearing sleeve.

A compressor according to the present invention compresses a fluid with a compression mechanism that has an impeller and a diffuser and is capable of supplying the compressed fluid to a condenser, in which the above-mentioned inlet guide vane is provided at the suction port into which the fluid is drawn by rotation of the impeller.

Also, the refrigerator of the present invention is a refrigerator including a condenser that cools and liquefies a compressed refrigerant; an evaporator that by evaporating the liquefied refrigerant takes heat of evaporation away from a cooling object to cool the cooling object; and a compressor that compresses the refrigerant that has been evaporated by the evaporator and supplies it to the condenser; in which the compressor is the above-mentioned compressor. A refrigerator according to the present invention includes: a condenser that cools and liquefies a compressed refrigerant; an evaporator that takes heat of evaporation away from a cooling object to cool the cooling object by evaporating the liquefied refrigerant; and a compressor that compresses the refrigerant evaporated by the evaporator and supplies the refrigerant to the condenser, the compressor being the above-mentioned compressor.

In the compressor and refrigerator according to the present invention, by having the above-mentioned inlet guide vane, it is possible to prevent a large thrust load from acting in a concentrated manner on the end portion of the bearing sleeve, and it is possible to lengthen the replacement life of the bearing sleeve.

According to the inlet guide vane, compressor and refrigerator according to the present invention, the flange portion of the shaft of the inlet guide vane is extended outward in the radial direction of the bearing sleeve, and the width of the flange portion in the direction perpendicular to the axis line is formed large. For this reason, it is possible to prevent a large thrust load from acting in a concentrated manner on the end portion of the bearing sleeve, and it is possible to prevent local, eccentric wear occurring on the bearing sleeve. Thereby, it is possible to prolong the life of the bearing sleeve.

Also, since by providing the large flange portion in the inlet guide vane in this way it becomes possible to enlarge the installation area thereof, it is possible to control the inclination angle of the inlet guide vane when pressed by the flowing of the fluid. Thereby, it is possible to prevent vibration of the inlet guide vane and by extension the compressor and the refrigerator that are equipped with it.

DETAILED DESCRIPTION OF THE INVENTION

Hereinbelow, an inlet guide vane and compressor and a refrigerator according to one embodiment of the present invention shall be described with reference to FIG. 1 to FIG. 7. The present embodiment relates to a refrigerator that cools or refrigerates a cooling object such as water, and relates to a turbo refrigerator that is provided with a turbo refrigerator that is constituted so as to perform compression of the refrigerant over a plurality of stages.

Figure 1:
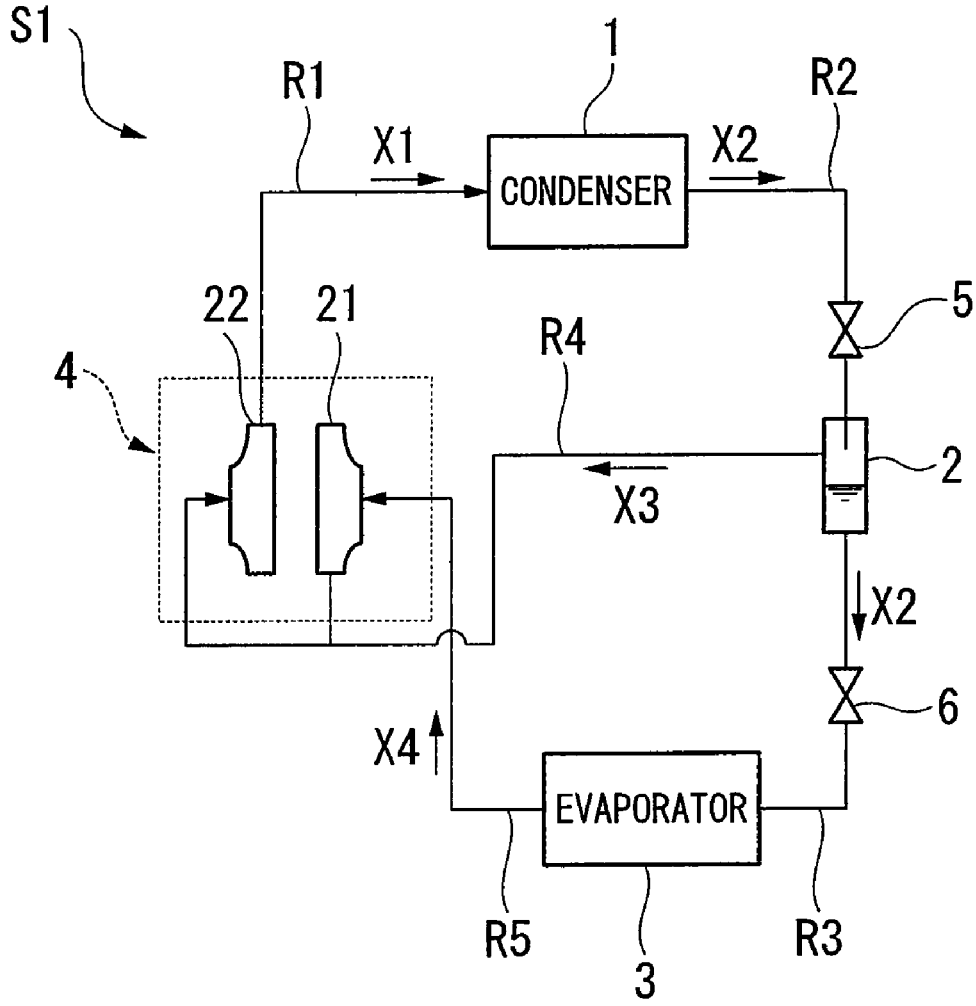
FIG. 1 is a block diagram showing an outline constitution of a turbo refrigerator according to one embodiment of the present invention.

FIG. 1 is a block diagram showing an outline constitution of a turbo refrigerator (refrigerator) S1 in the present embodiment.

The turbo refrigerator S1 in the present embodiment is for example installed in a building or a factory in order to generate the cooling water for air conditioning. The turbo refrigerator S1 is provided with a condenser 1, an economizer 2, an evaporator 3, and a turbo compressor (compressor) 4 as shown in FIG. 1.

A compressed refrigerant gas X1 which is a refrigerant (fluid) that is compressed in a gaseous state is supplied to the condenser 1, which by cooling and liquefying this compressed refrigerant gas X1, produces a refrigerant fluid X2. As shown in FIG. 1, this condenser 1 is connected with the turbo compressor 4 via a flow path R1 through which the compressed refrigerant gas X1 flows. The condenser 1 is connected with the economizer 2 via the flow path R2 through which the refrigerant fluid X2 flows. An expansion valve 5 for decompressing the refrigerant fluid X2 is installed in the flow path R2.

The economizer 2 temporarily stores the refrigerant fluid X2 that was decompressed with the expansion valve 5. This economizer 2 is connected with the evaporator 3 via a flow path R3 into which the refrigerant fluid X2 flows. The economizer 2 is connected with the turbo compressor 4 via a flow path R4 through which a gaseous refrigerant X3 produced in the economizer 2 flows. An expansion valve 6 for further decompressing the refrigerant fluid X2 is installed in the flow path R3. The flow path R4 is connected with the turbo compressor 4 so as to supply the gaseous refrigerant X3 to a second compression stage 22 with which the turbo compressor 4 is equipped and which is described later.

The evaporator 3 cools a cooling object, such as water, by evaporating the refrigerant fluid X2 to take heat of evaporation away from the cooling object. This evaporator 3 is connected with the turbo compressor 4 via a flow path R5 through which flows a refrigerant gas X4 that is produced by the evaporation of the refrigerant fluid X2. The flow path R5 is connected with a first compression stage 21 with which the turbo compressor 4 is equipped and which is described later.

The turbo compressor 4 compresses the refrigerant gas X4 to produce the above-mentioned compressed refrigerant gas X1.

This turbo compressor 4 is connected with the condenser 1 via the flow path R1 through which the compressed refrigerant gas X1 flows as described above, and is connected with the evaporator 3 via the flow path R5 through which the refrigerant gas X4 flows.

In the turbo refrigerator S1 that is constituted in this way, the compressed refrigerant gas X1 that is supplied to the condenser 1 via the flow path R1 is liquefied and cooled by the condenser 1 to become the refrigerant fluid X2.

When the refrigerant fluid X2 is supplied to the economizer 2 via the flow path R2, it is decompressed by the expansion valve 5 and temporarily stored in the economizer 2 in the decompressed state. Afterward, when the refrigerant fluid X2 is supplied to the evaporator 3 via the flow path R3, it is further decompressed by the expansion valve 6, and supplied to the evaporator 3 in the further decompressed state. The refrigerant fluid X2 that has been supplied to the evaporator 3 is evaporated by the evaporator 3 to become the refrigerant gas X4, and is supplied to the turbo compressor 4 via the flow path R5.

The refrigerant gas X4 supplied to the turbo compressor 4 is compressed by the turbo compressor 4 to become the compressed refrigerant gas X1, and is again supplied to the condenser 1 via the flow path R1.

The gaseous refrigerant X3 that is generated when the refrigerant fluid X2 was stored in the economizer 2 is supplied to the turbo compressor 4 via the flow path R4 where it is compressed with the refrigerant gas X4, and then supplied to the condenser 1 via the flow path R1 as compressed refrigerant gas Xi.

In such a turbo refrigerator S1, when evaporating the refrigerant fluid X2 with the evaporator 3, cooling or refrigerating of the cooling object is performed by taking heat of evaporation from the cooling object.

Figure 2:
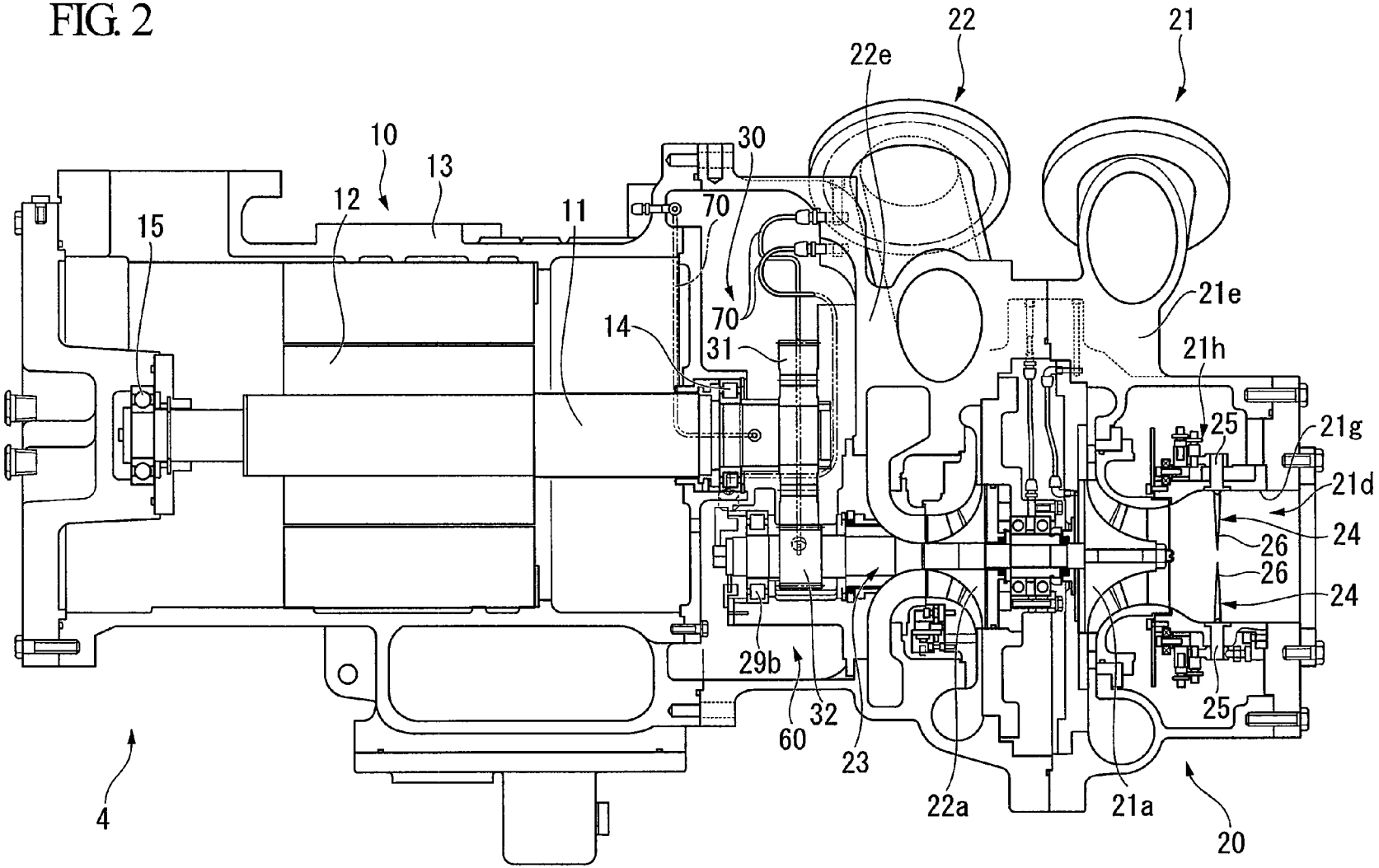
FIG. 2 is a horizontal sectional view showing a turbo compressor with which the turbo refrigerator according to the embodiment of the present invention is provided.
Figure 3:
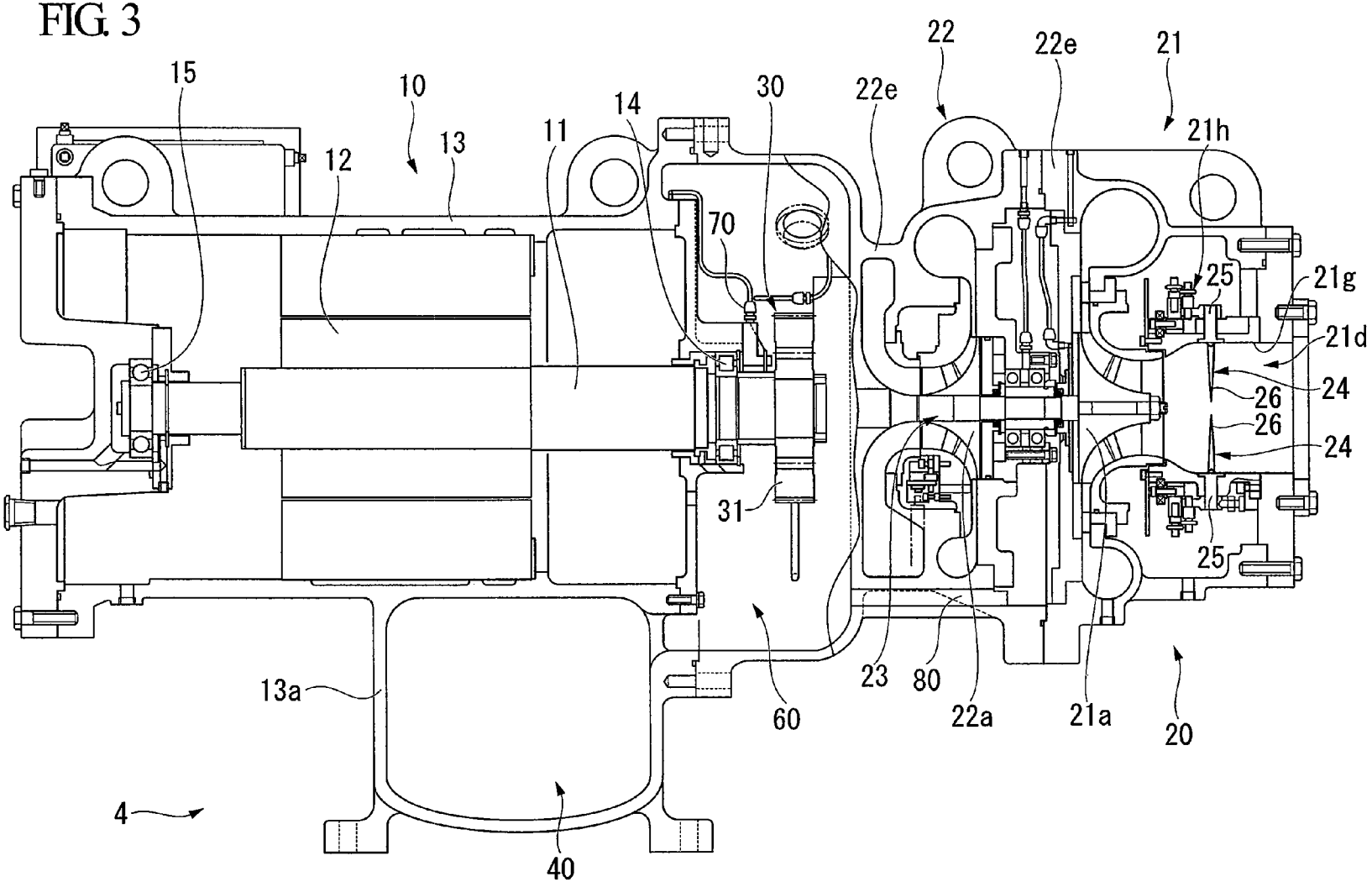
FIG. 3 is a vertical sectional view showing the turbo compressor with which the turbo refrigerator according to the embodiment of the present invention is provided.
Figure 4:
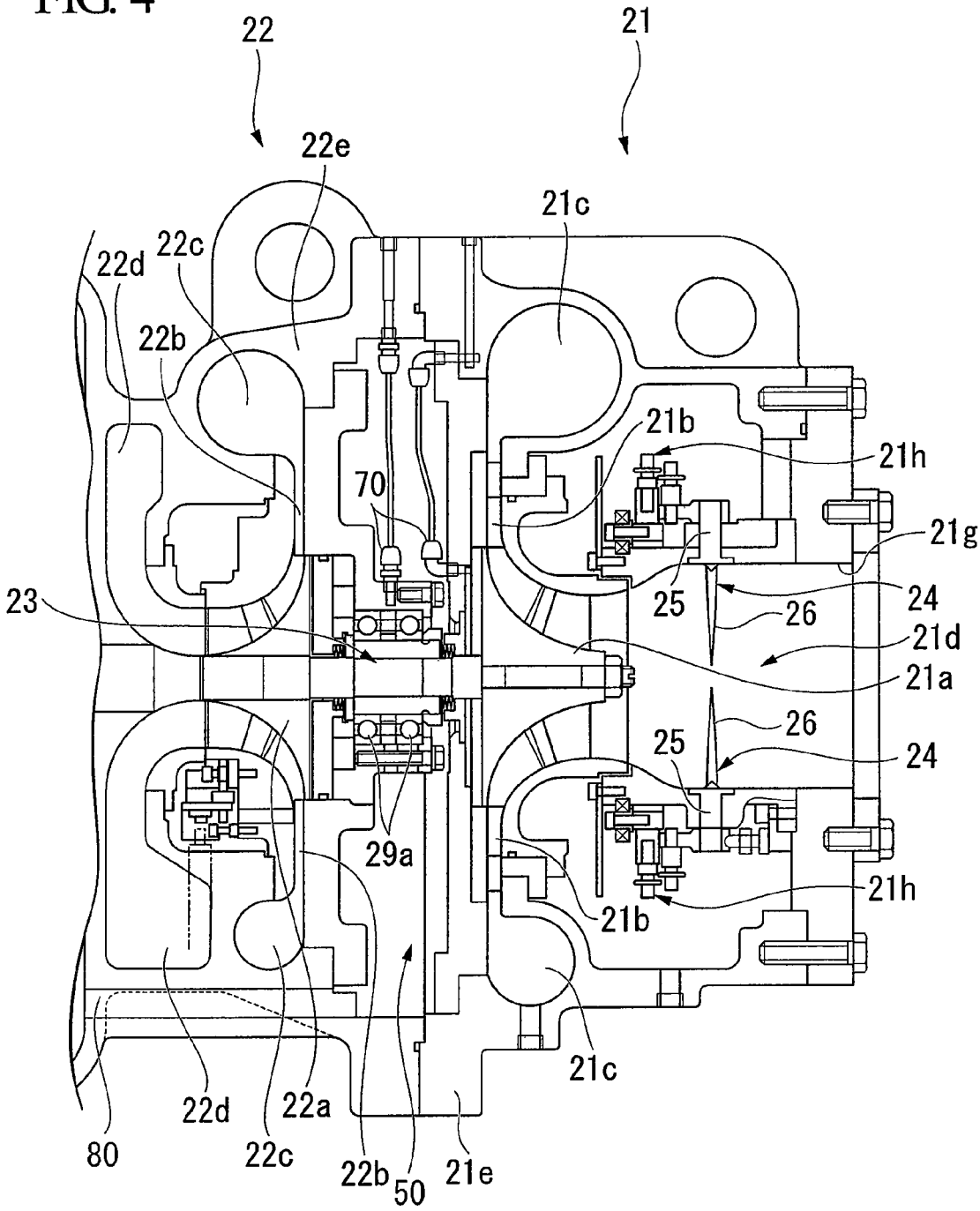
FIG. 4 is a main portion enlarged view of FIG. 3.

Next, the turbo compressor 4 shall be described in further detail. FIG. 2 is a horizontal sectional view of the turbo compressor 4. FIG. 3 is a vertical sectional view of the turbo compressor 4. FIG. 4 is an enlarged vertical sectional view of a compressor unit 20 with which the turbo compressor 4 is provided.

As shown in these figures, the turbo compressor 4 in the present embodiment is provided with a motor unit 10, the compressor unit 20, and a gear unit 30.

The motor unit 10 is provided with a motor 12 and a motor housing 13. The motor 12 serves as a drive source for driving the compressor unit 20. The motor housing 13 surrounds the motor 12 and supports the motor 12.

The output shaft 11 of the motor 12 is rotatably supported by a first bearing 14 and a second bearing 15 which are fixed to the motor housing 13.

The motor housing 13 is equipped with a leg 13*a* that supports the turbo compressor 4.

The inside of the leg 13*a* is hollow, and is used as an oil tank 40 in which lubricant that is supplied to the sliding region of the turbo compressor 4 is collected and stored.

The compression unit 20 is equipped with a first compression stage (compression mechanism) 21 and a second compression stage (compression mechanism) 22. The first compression stage 21 draws in and compresses the refrigerant gas X4 (refer to FIG. 1). The second compression stage 22 further compresses the refrigerant gas X4 that was compressed by the first compression stage 21, and discharges it as the compressed refrigerant gas X1 (refer to FIG. 1).

The first compression stage 21 is provided with a first impeller (impeller) 21*a*, a first diffuser 21*b*, a first scroll chamber 21*c*, and a suction port 21*d*. The first impeller 21*a* imparts velocity energy to the refrigerant gas X4 supplied from the thrust direction, and discharges it in the radial direction. The first diffuser 21*b* performs compression by converting the velocity energy imparted to the refrigerant gas X4 by the first impeller 21*a* into pressure energy. The first diffuser 21*b* performs compression by converting the velocity energy imparted to the refrigerant gas X4 by the first impeller 21*a* into pressure energy. The first scroll chamber 21*c* leads out the refrigerant gas X4 compressed by the first diffuser 21*b* to the outside of the first compression stage 21. The suction port 21*d* draws in the refrigerant gas X4 and supplies it to the first impeller 21*a*.

A portion of the first diffuser 21*b*, the first scroll chamber 21*c*, and the suction port 21*d* are formed by a first housing 21*e* surrounding the first impeller 21*a*.

The first impeller 21*a* is fixed to a rotation shaft 23. The first impeller 21*a* is rotatively driven by rotation of the rotation shaft 23 by transmission of rotation force from the output shaft 11 of a motor 12.

Figure 5:
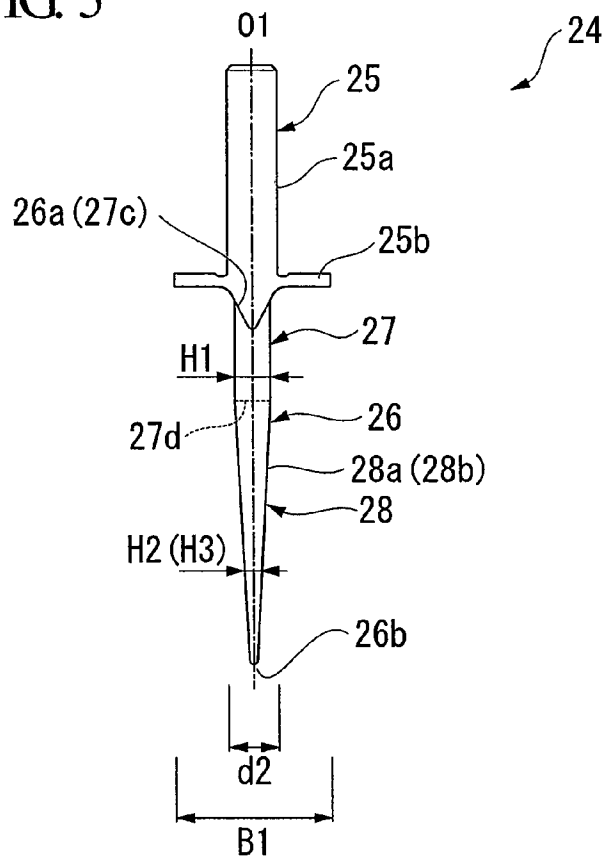
FIG. 5 is a front view showing an inlet guide vane according to the embodiment of the present invention.
Figure 6:
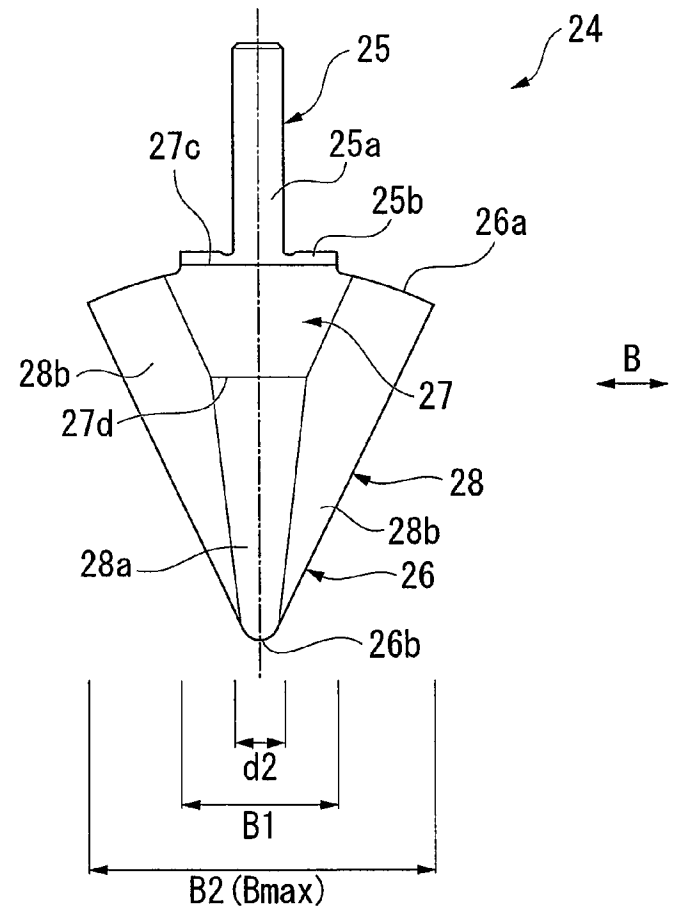
FIG. 6 is a side view showing the inlet guide vane according to the embodiment of the present invention.

When the first impeller 21*a* of the first compression stage 21 rotates, the refrigerant gas X4 is drawn into the suction port 21*d*. A plurality of inlet guide vanes 24 are installed in this suction port 21*d*. This inlet guide vane 24 includes a shaft 25 and a vane main body 26 joined in the state of a mutual axis line O1 being disposed coaxially at the distal end in the axis line O1 of this shaft 25, as shown in FIG. 5 and FIG. 6.

The shaft 25 includes a round bar-shaped shaft main body portion 25*a* and a flange portion 25*b* provided at the distal end in the axis line O1 direction to be joined with the vane main body 26. The flange portion 25*b* extends outward in a direction perpendicular to the axis line O1 direction, and is formed in an approximate disk shape joined to the shaft main body portion 25*a* to extend in the circumferential direction thereof centered on the axis line O1. The outer diameter of this flange portion 25*b* is a width B1 in a direction perpendicular to the axis line O1, and is a size of at least 1.5 times the outer diameter d2 of the shaft main body portion 25*a* and at least ⅓ of the maximum width Bmax (B2) of the vane main body 26.

On the other hand, the vane main body 26 is formed in an approximate fan shape when viewed from the side. That is, the vane main body 26 is formed in a circular shape with a back end 26*a* side in the axis line O1 direction joined to the shaft 25 having approximately the same curvature as the inner periphery surface 21*g* of the suction port 21*d* (refer to FIG. 2 to FIG. 4). The vane main body 26 as shown in FIG. 5 and FIG. 6 has a parallel portion 27 and a taper portion 28. The parallel portion 27 is disposed on the axis line O1 on the side of the back end 26*a* and joins with the flange portion 25*b* of the shaft 25. The taper portion 28 joins with the parallel portion 27, extends to the outside in the width direction B, and extends until the distal end 26*b* in the axis line O1 direction. The parallel portion 27 is formed with a constant thickness H1 from a back end 27*c* in the axis line O1 direction joined to the flange portion 25*b* of the shaft 25 until a distal end 27*d*.

The taper portion 28 includes a first taper portion 28*a* and a second taper portion 28*b*. The first taper portion 28*a* is arranged on the axis line O1, joins with the distal end 27*d* of the parallel portion 27 at a back end thereof, and extends along the axis line O1 direction until the vicinity of the distal end distal end 26*b* of the vane main body 26. The first taper portion 28*a* is formed so that the width B2 and thickness H2 gradually become smaller heading from the back end to the distal end 26*b* in the axis line O1 direction. The second taper portion 28*b* is arranged so as to joined to the parallel portion 27 and the first taper portion 28*a* at both sides in the width direction B of the parallel portion 27 and the first taper portion 28*a*, and extends from the back end 26*a* of the vane main body 26 to the distal end 26*b*. The second taper portion 28*b* is formed so that a thickness H3 gradually becomes smaller from the back end to the distal end while heading to the outside in the width direction B.

The inlet guide vane 24 that is constituted in this manner is supported by the shaft main body portion 25*a* of the shaft 25 being attached to a driving mechanism 21*h* that is fixed to the first housing 21*e*. Also, the inlet guide vane 24 is installed in the state of causing the vane main body 26 to project from the inner periphery surface 21*g* of the suction port 21*d* to the inside.

A through hole 21*k* for allowing insertion of the shaft 25 is formed in the inner periphery surface 21*g* of the first housing 21*e* at the portion which attaches the inlet guide vane 24. This through hole 21*k* includes a large diameter portion 21*m* on the side of the inner periphery surface 21*g* and a small diameter portion 21*n* on the outer periphery side. The large diameter portion 21*m* has an inner diameter that is approximately the same as the outer diameter (width B1) of the flange portion 25*b* of the shaft 25. A bearing sleeve 106 such as the sleeve bearing of the driving mechanism 21*h* that supports the shaft main body portion 25*a* in a manner capable of turning is fitted in the small diameter portion 21*n*. The small diameter portion 21*n* has an inner diameter that is approximately the same as the outer diameter d1 of this bearing sleeve 106.

The inlet guide vane 24 is supported by inserting the shaft main body portion 25*a* in the bearing sleeve 106 that is fitted in the small diameter portion 21*n* of this through hole 21*k*. Moreover, the inlet guide vane 24 is installed by causing the flange portion 25*b* to engage with the large diameter portion 21*m*. At this time, the inlet guide vane 24 is installed with the flange portion 25*b* of the shaft 25 extending outward to the outside in the radial direction of the bearing sleeve 106. The end surface (end portion 106*a*) of the bearing sleeve 106 is disposed so as to become flush with a bottom surface 21*p* of the large diameter portion 21*m*. The flange portion 25*b* is engaged with the large diameter portion 21*m* in the state of interposing a sliding member 21*s* between a surface 25*c* that faces the side of the shaft main body 25*a* and the end surface (end portion 106*a*) of the bearing sleeve 106 that is disposed in the manner described above. Thereby, the inlet guide vane 24 of the present embodiment is installed so as to received the flange portion 25*b* not only with the bearing sleeve 106 by also the first housing 21*e*.

This inlet guide vane 24 is installed to be capable of turning about the axis line O1 within a range of 90 degrees from the state of causing the one side surface of the vane main body 26 (side surface on the positive pressure side) to face the back side of the refrigerant gas X4 flow direction to following the flow direction.

The second compression stage 22, as shown in FIG. 2 to FIG. 4, has a second impeller 22*a*, a second diffuser (diffuser) 22*b*, a second scroll chamber 22*c*, and an introduction scroll chamber 22*d*. The second impeller 22*a* imparts velocity energy to the refrigerant gas X4 supplied from thrust along with being compressed by the first compression stage 21, and discharges it in the radial direction. The second diffuser 22*b* compresses the refrigerant gas X4 by converting the velocity energy that was imparted to the refrigerant gas X4 by the second impeller 22*a* to pressure energy, and discharges it as the compressed refrigerant gas X1. The second scroll chamber 22*c* leads the compressed refrigerant gas X1 discharged from the second diffuser 22*b* to the outside of the second compression stage 22. The introduction scroll chamber 22*d* leads the refrigerant gas X4 that was compressed by the first compression stage 21 to the second impeller 22*a*.

The second impeller 22*a* is fixed to the rotation shaft 23 so as to be back-to-back with the first impeller 21*a*. The second impeller 22*a* is rotatively driven by rotation of the rotation shaft 23 from rotation power that is transmitted from the output shaft 11 of the motor 12.

The second scroll chamber 22*c* is connected with the flow path R1 for supplying the compressed refrigerant gas X1 to the condenser 1. The second scroll chamber 22*c* supplies the compressed refrigerant gas X1 drawn from the second compression stage 22 to the flow path R1.

The first scroll chamber 21*c* of the first compression stage 21 and the introduction scroll chamber 22*d* of the second compression stage 22 are connected through external piping (not illustrated) that is provided independently from the first compression stage 21 and the second compression stage 22. The refrigerant gas X4 compressed by the first compression stage 21 via this external piping is supplied to the second compression stage 22. The above-mentioned flow path R4 (refer to FIG. 1) is connected to this external piping. The gaseous refrigerant X3 generated in the economizer 2 is supplied to the second compression stage 22 via the external piping.

The rotation shaft 23 is rotatably supported by a third bearing 29*a* and a fourth bearing 29*b*. The third bearing 29*a* is fixed to a second housing 22*e* of the second compression stage 22 in a space 50 between the first compression stage 21 and the second compression stage 22. The fourth bearing 29*b* is fixed to the second housing 22*e* on the side of the motor unit 10.

The gear unit 30 transmits the rotation power of the output shaft 11 of the motor 12 to the rotation shaft 23. The gear unit 30 is stored in a space 60 formed by the motor housing 13 of the motor unit 10 and the second housing 22*e* of the compressor unit 20.

This gear unit 30 is constituted by a large diameter gear 31 that is fixed to the output shaft 11 of the motor 12, and a small diameter gear 32 that meshes with the large diameter gear 31 while being fixed to the rotation shaft 23. The gear unit 30 transmits the rotation power of the output shaft 11 of the motor 12 so that the rotational frequency of the rotation shaft 23 increases with respect to the rotational frequency of the output shaft 11 to the rotation shaft 23.

The turbo compressor 4 is provided with a lubricant-supplying device 70 that supplies the lubricant stored in the oil tank 40 to between the bearings (the first bearing 14, the second bearing 15, the third bearing 29*a*, and the fourth bearing 29*b*), the impellers (the first impeller 21*a* and the second impeller 22*a*) and the housings (the first housing 21*e* and the second housing 22*e*) and the sliding region of the gear unit 30 and the like.

Next, the operation of the turbo compressor 4 constituted in this way shall be described. Moreover, the action and effect of the inlet guide vanes 24, the turbo compressor 4, and the turbo refrigerator S1 according to the present embodiment are described.

First, the lubricant is supplied to the sliding region of the turbo compressor 4 by the lubricant-supplying device 70 from the oil tank 40. Then, the motor 12 is driven. The rotation power of the output shaft 11 of the motor 12 is transmitted to the rotation shaft 23 through the gear unit 30. The first impeller 21*a* and the second impeller 22*a* of the compressor unit 20 are thereby rotatively driven.

When the first impeller 21*a* rotates, the suction port 21*d* of the first compression stage 21 enters a negative pressure state, and the refrigerant gas X4 from the flow path R5 flows into the first compression stage 21 through the suction port 21*d*. Also, by driving the driving mechanism 21*h* and turning each inlet guide vane 24 that is installed in the suction port 21*d*, the side surface of the positive pressure side of the vane main body 26 is disposed at a suitable angle of attack (turning angle) with respect to the flow direction of the refrigerant gas X4. Thereby, the suction amount and the flow direction of the refrigerant gas X4 to the first compression stage 21 are adjusted.

Figure 7:
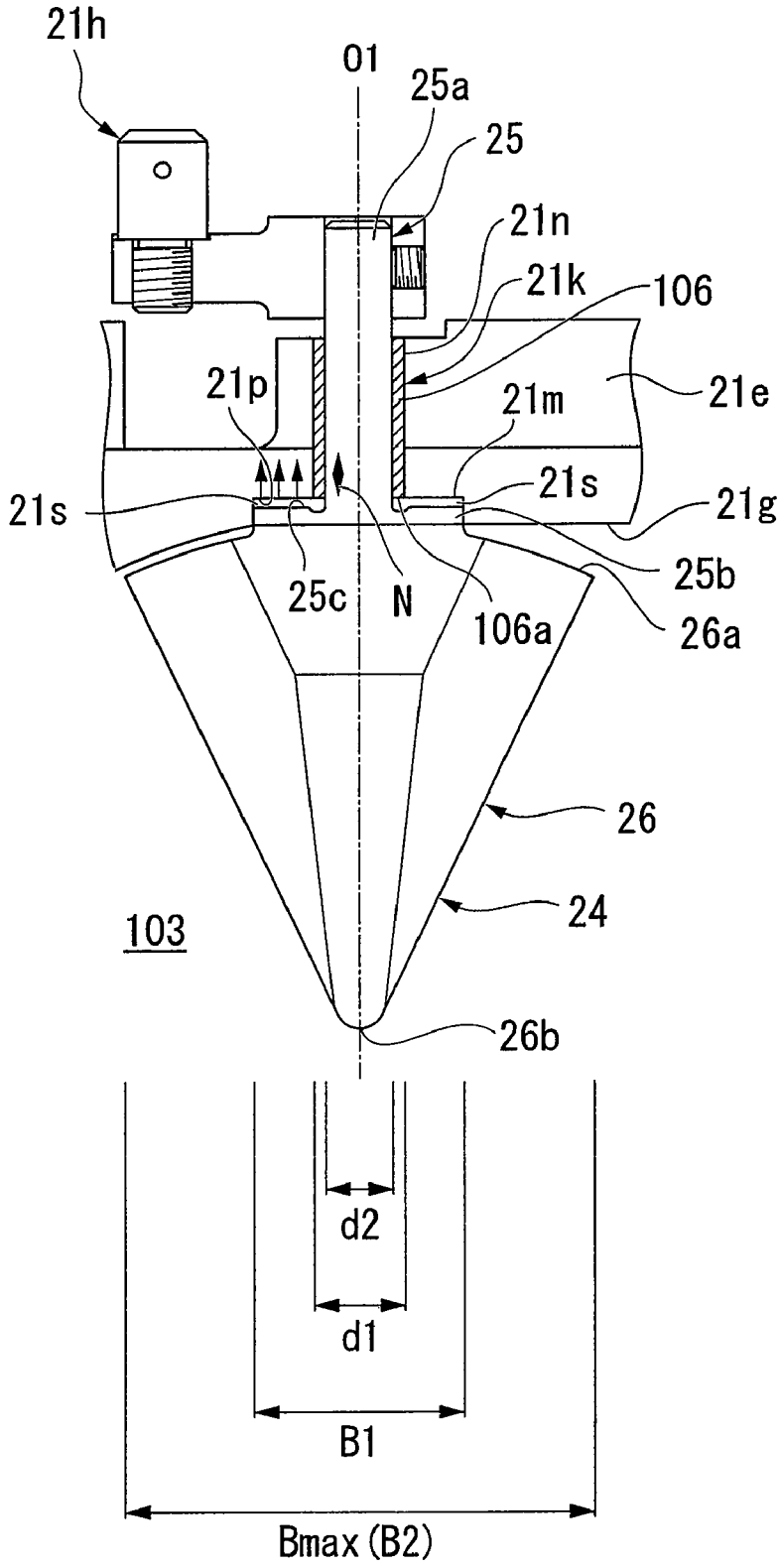
FIG. 7 shows the state of the inlet guide vane according to the embodiment of the present invention installed in a suction port of the compressor.
Figure 8:
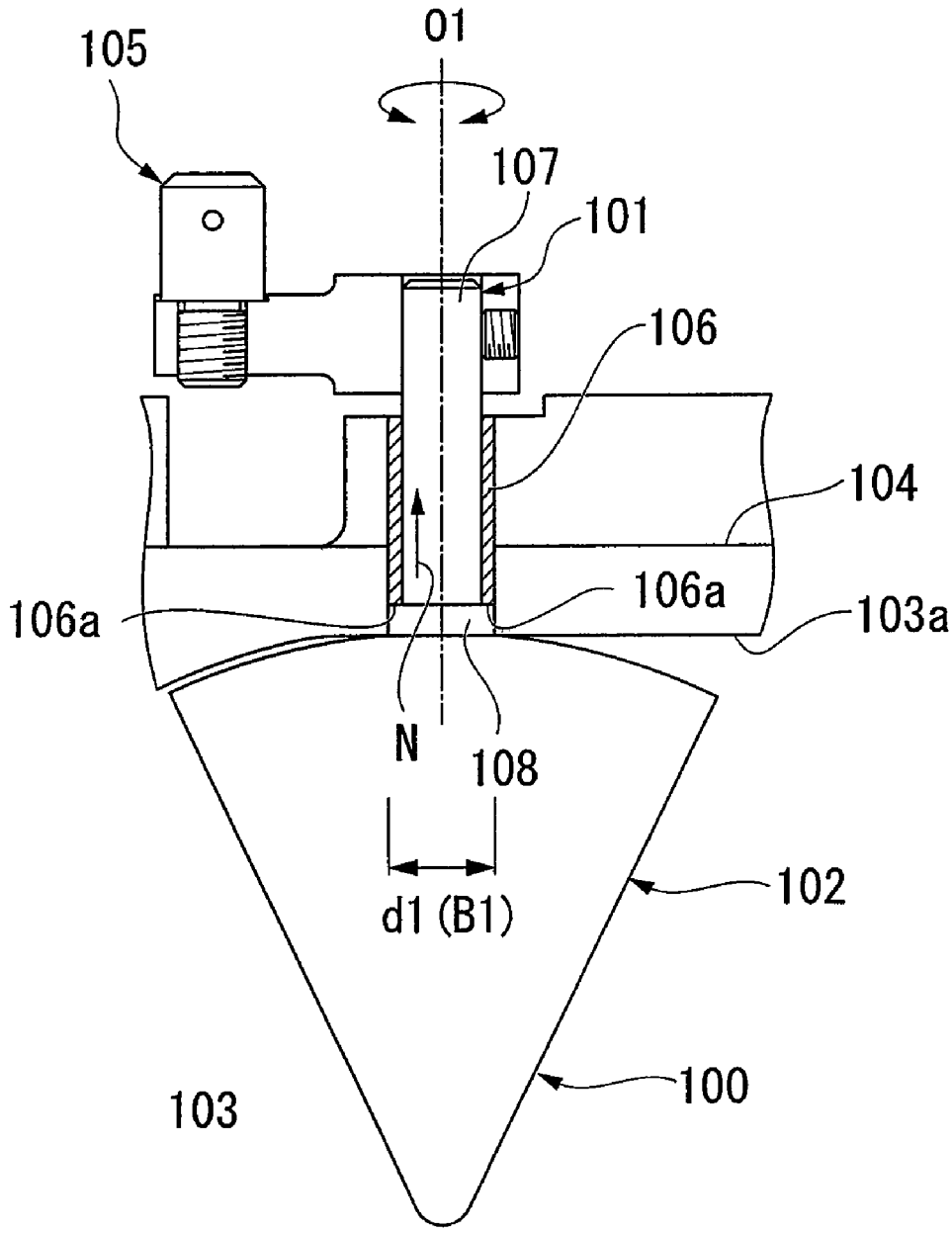
FIG. 8 shows the state of a conventional inlet guide vane installed in a suction port of a compressor.

At this time, the inlet guide vanes 24 are pressed by the flow of the refrigerant gas X4, the flange portion 25*b* makes partial contact, and the thrust load N acts on the bearing sleeve 106 as shown in FIG. 7.

In contrast, in the present embodiment, the flange portion 25*b* of the shaft 25 extends outward in the radial direction of the bearing sleeve 106, so that the width B1 thereof (outer diameter) is formed large. By having such a structure, when the inlet guide vanes 24 are pressed by the flow of the refrigerant gas X4 (when adjusting the flow amount and flow direction of the refrigerant gas X4) the thrust load N is distributed and acts not only on the end surface 106*a* of the bearing sleeve 106 but also on the bottom surface 21*p* of the large diameter portion 21*m* that the flange portion 25*b* is engaged with. That is, by enlarging the surface area on which the thrust load N acts in this way, the surface pressure decreases without the large thrust load N acting in a concentrated (local) manner on the end portion 106*a* of the bearing sleeve 106 in the conventional manner. Thereby, the replacement life of the bearing sleeve 106 is prolonged without local eccentric wear occurring at the bearing sleeve 106.

Moreover, the width B1 of the flange portion 25*b* is of a size of at least 1.5 times the outer diameter d2 of the shaft main body portion 25*a* and at least ⅓ of the maximum width Bmax (B2) of the vane main body 26. By having such a structure, the acting of a large thrust load N in a concentrated manner on the end portion 106*a* of the bearing sleeve 106 is reliably prevented.

Moreover, since the inlet guide vanes 24 are equipped with the large flange portion 25*b*, the installation area of the inlet guide vanes 24 becomes large. Due to this, the inclination angle of the inlet guide vanes 24 when pressed by the flowing of the refrigerant gas X4 is controlled. Thereby, prevention of vibration of the inlet guide vanes 24, and by extension the compressor 4 and refrigerator S1 in which they are installed, is achieved.

Thus, the refrigerant gas X4 whose suction amount and flow direction were adjusted by the inlet guide vanes 24 to flow into the interior of the first compression stage 21 flows into the first impeller 21*a* from the thrust direction, receives velocity energy by the first impeller 21*a*, and is discharged in the radial direction.

The refrigerant gas X4 that has been discharged from the first diffuser 21*b* is lead out to the outside of the first compression stage 21 via the first scroll chamber 21*c*, and is supplied to the second compression stage 22 via the external piping. The refrigerant gas X4 that has been supplied to the second compression stage 22 flows into the second impeller 22*a* from the thrust direction via the introduction scroll chamber 22*d*, receives velocity energy by the second impeller 22*a*, and is discharged in the radial direction. The refrigerant gas X4 that has been discharged from the second impeller 22*a* is further compressed by the velocity energy being converted into pressure energy by the second diffuser 22*b*, to be made into the compressed refrigerant gas X1.

Therefore, in the inlet guide vane 24 of the present embodiment, the flange portion 25*b* of the shaft 25 extends out to the outside in the radial direction of the bearing sleeve 106 and the width B1 thereof in the direction perpendicular to the axis line O1 is formed large. By having such a structure, when the inlet guide vanes 24 are pressed by the flow of the refrigerant gas X4, it is possible to cause the thrust load N to act not only on the bearing sleeve 106 but also on the first housing 21e that the flange portion 25*b* is engaged with. That is, it is possible to enlarge the surface area on which the thrust load N acts. Thereby, it is possible to prevent a large thrust load N from acting in a concentrated manner on the end portion 106*a* of the bearing sleeve 106, and it is possible to reliably prevent local, eccentric wear occurring on the bearing sleeve 106. Thereby, the replacement life of the bearing sleeve 106 can be prolonged.

Moreover, the width B1 of the flange portion 25*b* is of a size of at least 1.5 times the outer diameter d2 of the shaft main body portion 25*a* and at least ⅓ of the maximum width Bmax (B2) of the vane main body 26. By having such a structure, the acting of a large thrust load N in a concentrated manner on the end portion 106*a* of the bearing sleeve 106 is reliably prevented.

Moreover, by providing the large flange portion 25*b* in the inlet guide vanes 24 in this way to enlarge the installation area thereof, it is possible to control the inclination angle of the inlet guide vanes 24 when pressed by the flowing of the refrigerant gas X4. Thereby, the compressor 4 according to the present embodiment and the refrigerator S1 that is equipped with it can prevent vibration.

Note that while preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims. For example, in the present embodiment, the vane main body 26 of the inlet guide vane 24 has the parallel portion 27 and the taper portion 28. However, the inlet guide vane according to the present invention need not limit the constitution of the vane main body 26, provided the shaft 25 is provided with the flange portion 25*b* that extends to the outside in the radial direction of the bearing sleeve 106 at the distal end side in the axis line O1 direction that joins with the vane main body 26.

Also, in the present embodiment, the width B1 of the flange portion 25*b* of the shaft 25 is of a size of at least 1.5 times the outer diameter d2 of the shaft main body portion 25*a* and at least ⅓ of the maximum width Bmax (B2) of the vane main body 26. However, provided the flange portion 25*b* is formed so as to extend to the outside in the radial direction of the bearing sleeve 106, it need not have the width B1 of at least 1.5 times the outer diameter d2 of the shaft main body portion 25*a* and/or at least ⅓ of the maximum width Bmax (B2) of the vane main body 26. Also, in FIG. 5 to FIG. 7, the width B1 of the flange portion 25*b* is shown as being smaller than the maximum width Bmax of the vane main body 26. However, the flange portion 25*b* may have a width B1 that is larger than the maximum width Bmax of the vane main body 26.

Moreover, in the present embodiment, the description is given of the inlet guide vane 24 being installed in the suction port 21*d* of the turbo compressor 4. However, there is no need to restrict the inlet guide vane according to the present invention to use in a turbo compressor.

What is claimed is:

1. An inlet guide vane that is turnably installed about an axis line at a suction port into which a fluid is drawn by rotation of an impeller in order to adjust a suction amount and flow direction of the fluid, the inlet guide vane comprising:

a shaft that is turnably supported by inserting a round bar-shaped shaft main body portion thereof in a bearing sleeve; and a plate-shaped vane main body that is joined with the shaft and projects from an inner periphery surface of the suction port to a central portion of the suction port, the shaft including a flange portion that is provided at a distal end side in a direction of the axis line to join with the vane main body and that extends to an outside in a direction perpendicular to the axis line so as to be extended outward in a radial direction of the bearing sleeve, wherein a width of the flange portion in the direction perpendicular to the axis line is a size of at least 1.5 times an outer diameter of the shaft main body portion and/or at least ⅓ of a maximum width of the vane main body.

2. A compressor that compresses a fluid with a compression mechanism that has an impeller and a diffuser and is capable of supplying the compressed fluid to a condenser, the compressor comprising:

an inlet guide vane comprising, a shaft that is turnably supported by inserting a round bar-shaped shaft main body portion thereof in a bearing sleeve; and a plate-shaped vane main body that is joined with the shaft and projects from an inner periphery surface of a suction port to a central portion of the suction port, the shaft including a flange portion that is provided at a distal end side in a direction of the axis line to join with the vane main body and that extends to an outside in a direction perpendicular to the axis line so as to be extended outward in a radial direction of the bearing sleeve, wherein a width of the flange portion in the direction perpendicular to the axis line is a size of at least 1.5 times an outer diameter of the shaft main body portion and/or at least ⅓ of a maximum width of the vane main body and wherein the inlet guide vane is provided at the suction port into which the fluid is drawn by rotation of the impeller and wherein the inlet guide vane is turnably installed about an axis line at the suction port in order to adjust a suction amount and flow direction of the fluid.

3. A refrigerator comprising:

a condenser that cools and liquefies a compressed refrigerant;

an evaporator that takes heat of evaporation away from a cooling object to cool the cooling object by evaporating the liquefied refrigerant; and a compressor that compresses the refrigerant evaporated by the evaporator and supplies the refrigerant to the condenser, the compressor being a compressor that compresses a fluid with a compression mechanism that has an impeller and a diffuser and is capable of supplying the compressed fluid to a condenser, the compressor comprising, an inlet guide vane that is turnably installed about an axis line at a suction port into which a fluid is drawn by rotation of the impeller in order to adjust a suction amount and flow direction of the fluid, the inlet guide vane comprising:

a shaft that is turnably supported by inserting a round bar-shaped shaft main body portion thereof in a bearing sleeve; and a plate-shaped vane main body that is joined with the shaft and projects from an inner periphery surface of the suction port to a central portion of the suction port, the shaft including a flange portion that is provided at a distal end side in a direction of the axis line to join with the vane main body and that extends to an outside in a direction perpendicular to the axis line so as to be extended outward in a radial direction of the bearing sleeve.

4. The refrigerator according to claim 3, wherein a width of the flange portion in the direction perpendicular to the axis line is a size of at least 1.5 times an outer diameter of the shaft main body portion and/or at least ⅓ of a maximum width of the vane main body.

* * * * *